United States Patent [19]

Stewart

[11] Patent Number: 4,706,435

[45] Date of Patent: Nov. 17, 1987

[54] PREFABRICATED INTERLOCKING ROOFING SYSTEM

[75] Inventor: Victor M. Stewart, Redmond, Wash.

[73] Assignee: Industrial Research Development, Inc., Kirkland, Wash.

[21] Appl. No.: 938,722

[22] Filed: Dec. 2, 1986

[51] Int. Cl.[4] ..... E04D 1/28; E04D 3/35

[52] U.S. Cl. ..... 52/533; 52/540

[58] Field of Search ..... 52/540, 533

[56] References Cited

U.S. PATENT DOCUMENTS

| | | | |
|---|---|---|---|
| 1,438,780 | 12/1922 | O'Neil | 52/540 |
| 2,148,167 | 2/1939 | Lyman | 52/540 X |
| 2,537,154 | 1/1951 | Norrid | 52/540 X |
| 3,034,261 | 5/1962 | Hollmann et al. | 52/553 |
| 3,111,787 | 11/1963 | Chamberlain | 52/540 X |
| 3,468,086 | 9/1969 | Warner | 52/540 X |
| 4,187,653 | 2/1980 | Kliewer, Jr. | 52/540 X |
| 4,586,304 | 5/1986 | Flammand | 52/540 X |

FOREIGN PATENT DOCUMENTS

| | | | |
|---|---|---|---|
| 511158 | 3/1955 | Canada | 52/553 |
| 129850 | 6/1901 | Fed. Rep. of Germany | 52/540 |
| 1135697 | 12/1956 | France | 52/553 |
| 913557 | 12/1962 | United Kingdom | 52/540 |

*Primary Examiner*—Alfred C. Perham

*Attorney, Agent, or Firm*—Berman, Aisenberg & Platt

[57] ABSTRACT

A prefabricated roofing panel has two opposite parallel edges bevelled at an angle to the top and bottom flat surfaces, and a portion of each bevelled edge is blunt cut adjacent one of the flat surfaces to enable interlocking of the panels. Each panel has a sidelap on one side extending across a bevelled edge, and a headlap at one end. The panels are installed with adjacent bevelled edges in interlocking engagement.

17 Claims, 4 Drawing Figures

FIG. 1
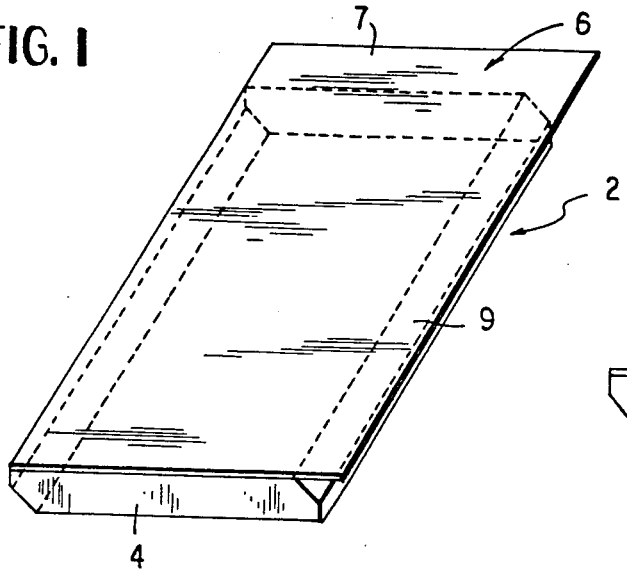
FIG. 2
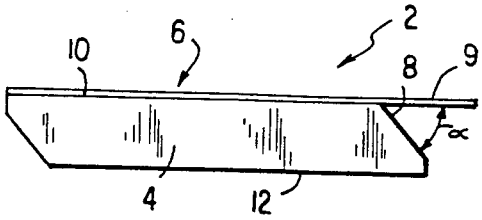
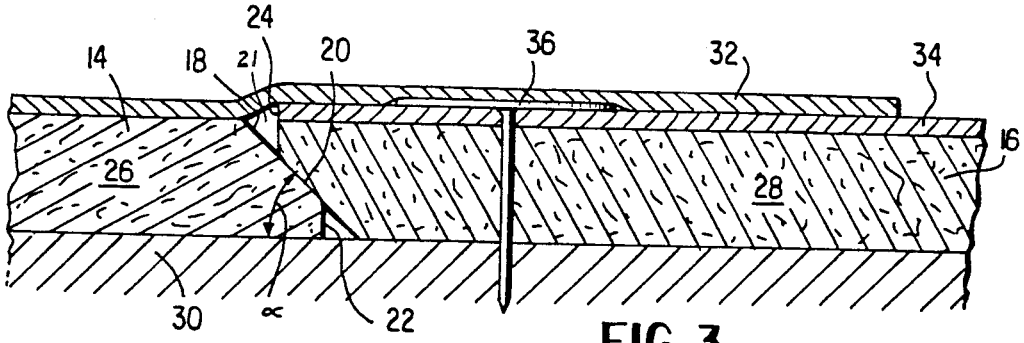
FIG. 3
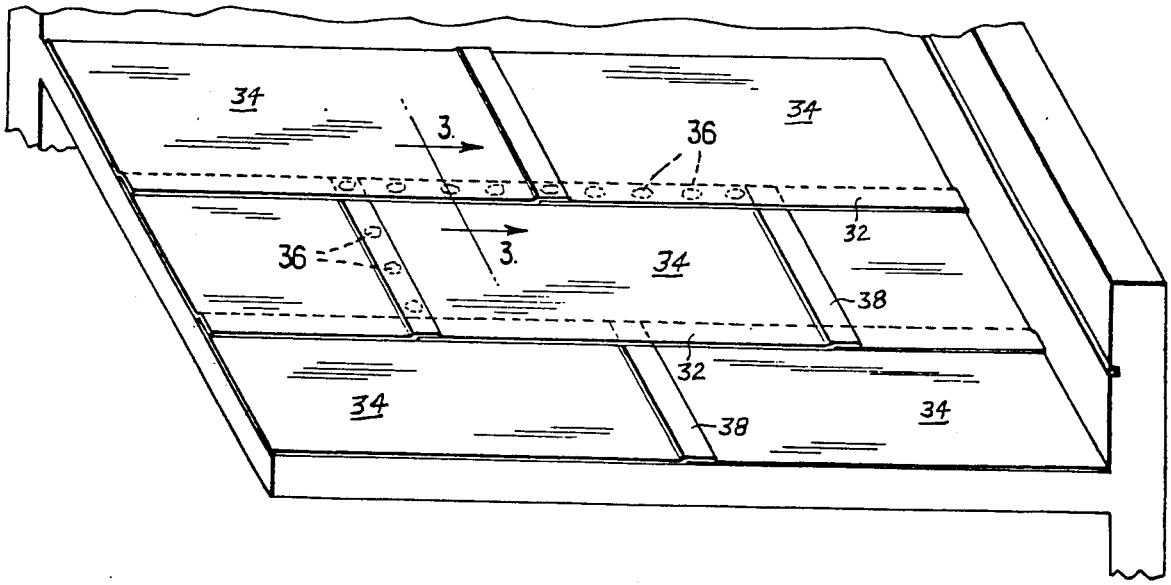
FIG. 4

PREFABRICATED INTERLOCKING ROOFING SYSTEM

FIELD OF THE INVENTION

This invention relates to the roofing art, particularly to the application of protective outer surfaces on roofs.

BACKGROUND OF THE INVENTION

This invention is an improvement om my prior prefabricated roofing panel, titled "Roofing Systems", Ser. No. 649,309, filed Sept. 11, 1984. In that patent application, a prefabricated panel having an attached waterproof membrane is described. The membrane is adhered to the top surface of the panel leaving uncovered an edge strip along each side edge of the panel. The prefabricated panels are installed in rows with alternate rows of spacers, a further waterproof membrane being installed at the roofing site to cover each row of spacers and the adjoining uncovered edges of the roofing panels.

Gantner, U.S. Pat. No. 4,078,349, provides an insulated lining for a roof consisting of rectangular boards, each board being covered with a hard covering including a headlap and a sidelap. The system of Gantner is not a waterproof roofing system, but is a system of using insulation panels for interior use. Warner, U.S. Pat. No. 3,468,086 describes an interlocking prefabricated roofing system having a stepped interlocking system. The system of Warner does not allow for any irregularities in the roofing and the panels must fit into each other exactly. Johnson, U.S. Pat. No. 2,717,668, shows a panel having obliquely cut ends which are set adjacent to each other to provide a tight seal. The panel is described for interior use.

SUMMARY OF THE INVENTION

The techniques employed in the prior art are expensive in that they require panels uniquely constructed for the particular purpose and require a significant length of time for installation of the panels. In areas of the country where there is a significant amount of rain, it is particularly imperative that a roofing system be capable of complete installation in a minimum length of time, and this is not possible with prior systems. Moreover, it is preferable that the materials required be easily obtained or that the panels be constructed from materials of standard size to reduce the cost.

In accordance with the invention, roofing panels are provided comprising prefabricated panels having a waterproof protective covering applied thereon. The covering is applied with a headlap at one end and a sidelap along one side of the panel. The panel is diagonally cut to form a bevelled surface along a pair of opposite edges, generally the longer pair of side edges of the panel, and preferably with an additional cut blunting the bevelled surface adjacent the top flat surface of the panel at the edge without the sidelap, and adjacent the bottom flat surface of the panel at the edge covered by the sidelap. The blunt edge portion of the diagonally cut surface enables the prefabricated panels to be interlocked, without the necessity of exact mating, and provides a channel beneath the secured slidelap for escape of moisture and/or gases in the system to the atmosphere.

An object of the invention is to provide a unique prefabricated panel for ready installation on a roof.

BRIEF DESCRIPTION OF THE DRAWINGS

FIG. 1 is a perspective view of a prefabricated roofing panel of the invention.

FIG. 2 is an enlarged end view of the panel of FIG. 1.

FIG. 3 is a cross section taken on line 3—3 of FIG. 4.

FIG. 4 is a top perspective view of an installation of interlocking roofing panels of the invention.

DETAILED DESCRIPTION OF THE INVENTION

Referring to FIGS. 1 and 2, in which like numerals represent like parts, panel 2 is formed from a base panel member 4 and a waterproof covering membrane 6 which is preferably laminated to the panel at the factory. Panel 4 is typically a 3 ft. by 8 ft. by ½ in. rectangular fiberboard panel, as is known in the roofing art. Other types of panel may be used. A bitumenized waterproof membrane may be laminated to the panel by application of heat to the membrane, and then pressing it onto the panel. Other adhesive methods are also appropriate.

Opposite side edge surfaces of the panel are each cut to form a bevelled side edge surface 8 to enable adjacent panels to interlock with each other. The bevelled surfaces are preferably, but not necessarily, adjacent the longer parallel edges of the panel. The preferred angle of cut ($\alpha$), shown in FIGS. 2 and 3, is an acute angle, between 30° and 60°, and preferably about 45° to the horizontal. Bevelled surface 8 is cut at 45° to top surface 10 and to bottom surface 12 of panel 4.

FIG. 3 shows two panels 14 and 16 interlocking with each other, by the abutment of bevelled surfaces 18 and 20. If bevelled surfaces 18 and 20 are diagonally cut from the horizontal top surface to horizontal bottom surface of panels 14 and 16, problems may arise in butting the panels adjacent to each other if any extraneous matter is present, for example, grit on the roof, or excess adhesive squeezed out where the sidelap meets the panel. Blunt surfaces 22 and 24, perpendicular to the top and bottom flat surfaces of the panel, are cut along one edge of each bevelled surfaces 18 and 20, respectively, to accommodate such differences. Blunt surfaces 22 and 24 also accommodate slight differences in height, if roofing substrate 30 is uneven.

The blunt cut portion is particularly important for providing channels 21 beneath the waterproof membrane, between the panels. When certain types of insulation, such as polyisocyanurate foam insulation, is used, gases are produced by the insulation which causes blistering of the membrane unless "breathing" channels are provided. Channels 21 vent to the atmosphere under conventional coping strips, or through roofing cants, such as the cants described in my copending application Ser. No. 900,321, filed Aug. 26, 1986.

Prefabricated panels 26 and 28 are manufactured in the factory and shipped to the roofing site. Each panel is, for example, a rectangular fiberboard panel, preferably 3 ft. wide by 8 ft. long, and opposite side edges are bevelled and blunt cut, the cut at one side being a blunt cut adjacent the top surface and a bevelled cut adjacent the bottom surface, and the cut at the opposite side of the same panel being a bevelled cut adjacent the top surface and a blunt cut adjacent the bottom surface. When the roofing membrane is factory applied, the membrane is preferably set with one edge flush with the side of the panel having the blunt cut adjacent the top surface and the sidelap extending from the side edge having the bevelled cut adjacent the top surface. The opposite pairs of edges, forming the two shorter ends of the panel, are both blunt cut, perpendicular to the top and bottom flat surfaces of the panel, and the roofing membrane is fixed flush with one end and having a headlap at the other end. The roofing membrane is a bitumenized waterproof membrane or other waterproof membrane known to one skilled in the art.

Referring to FIG. 3 it is seen that panels 26 and 28 are supported on substrate 30. Panel 26 has sidelap 32 extending across interlocked bevelled surfaces 18 and 20, and panel 28 has membrane 34 affixed flush with the edge of blunt cut portion 24. When the panels are placed in position on substrate 30 they may be secured in place with conventional fasteners 36 which secure a panel to the substrate. The tops of fasteners 36 are concealed by sidelap 32 and headlap 38, as shown in FIG. 4.

In use, in laying a waterproof roof covering, installation of the roofing system is started by placing a panel at the roof drain, bottom of the slope, or low point of the roof, with the headlap running in the direction of the water flow. Hot asphalt or adhesive is spot-mopped on the panel along the sidelap and headlap edges and the panel is laid in place. The panel is fastened along the other two edges with fasteners 36 at not less than 1 ft. centers. Other arrangements of fasteners may be used, as appropriate. The panels may also be fully adhered to the roofing substrate.

The roofing substrate is strip-mopped or spot-mopped prior to installing the panels. Strip-mopping is used, preferably perpendicularly to the slope of the roof, by strip-mopping 1 in. hot asphalt strips spaced 4–6 in. apart on the roofing substrate. Spot-mopping is preferred for a flat roof. Strip mopping or spot mopping allows moisture or gases in the roofing substrate to escape through panels 26, 28 to channels 21, and (via roofing cants or coping) to the atmosphere.

Panels are installed in a row by butting an adjacent panel under the headlap of the previous panel. When the first row is completed the second row is placed in position. The first panel of the second row is cut, preferably in half, so that the seams are staggered with respect to the seams of the first row of panels. The second row of panels is laid with sidelaps overlapping the first row of panels and bevelled side edges of the second row of panels interlocking with bevelled side edges of the first row of panels. Subsequent rows of panels are similarly laid with the panel end under the headlap of the previous panel and bevelled side edges interlocking with bevelled side edges of the previously laid row of panels. The headlaps and sidelaps are adhered over the fastened edges of the previously laid, adjacent panels by torching or by application of adhesive or hot asphalt. Channels are formed between the secured sidelaps and adjoining bevelled side edges of one row of panels and the blunt cut portion of the side edges of the adjoining row of panels, whereby moisture and/or gases in the roofing system are channeled to the atmosphere through the channels and through cants, vents and copings subsequently applied to the roof.

Cants and flashings may be installed at the roof edges. The roof may be coated with a final coat of waterproof material and/or sheet metal counter flashing or coping may be added, as appropriate.

The panel is typically a 3 ft. by 8 ft. by ½ in. rectangular fiberboard panel. The waterproof roofing membrane may be a 160 mil. APP or SBS modified bitumen membrane, heat applied under pressure in the factory, as is known to one skilled in the art. The type of fasteners used depend upon the roof substrate and the insulation used (if any). Known fasteners, appropriately used, counteract any tendency of the panel to uplift. The panels and method of fastening meet the Factory Mutual (FM) wind uplift requirements I-60 and I-90. For wooden roofing substrates nails are used at about 1 ft. centers. For metal or concrete roofing substrates, appropriate fastenings, for example, using self-tapping screws, are employed.

Typically a 3 ft. by 8 ft. panel is covered by a waterproof membrane 3 ft. 3 in. wide and 8 ft. 6 in. long, thus forming a 3 in. side lap and a 6 in. headlap. The bevelled side edges may each have a ⅛ in. blunt cut portion adjacent one panel surface, as described above.

Using the prefabricated roofing panels of the invention, application is three times faster than using conventional roofing membrane application in the field, a particularly important factor in areas where rainy weather prevails. Prefabrication also ensures excellent quality control since the prefabricated panels are manufactured under controlled factory conditions, in which complete adhesion of the membrane to the panel is achieved. Field applied membranes often suffer from inadequate adhesion to the roofing panel. The roofing system of the invention may be installed in marginal weather conditions, obviating delay.

A fire-retardant protective coating or sheet may be added to the panel to prevent burning. This is particularly useful for field-applied membranes, but is also useful for factory manufactured panels.

The system adds insulation value to the roof, is simple to install, provides channels for escape of gases and moisture, and offers a choice of fastening methods. The roofing of the invention may be used for new installation, for re-roofing, or for application to sidewalls.

While the invention has been described above with respect to certain embodiments thereof, it will be appreciated that various changes and modifications may be made without departing from the spirit and scope of the invention.

What is claimed is:

1. A prefabricated roofing panel comprising:

panel means for covering a roof, said panel means comprising top and bottom flat surfaces and two opposite parallel side edges bevelled at an angle to said top and bottom surfaces, and waterproof membrane means for covering said panel means, completely covering and adhered to the top surface of said panel means, said membrane means extending outwardly from said panel means at one end to form a headlap and at one side to form a sidelap, wherein the panel means is a rectangular panel and the longer pair of opposite side edges is bevelled, the sidelap extending across one of said bevelled side edges, and wherein a portion of a bevelled side edge is blunt cut adjacent a flat surface of the panel forming a bevelled portion adjacent one surface of the panel and a blunt cut portion adjacent the other surface of the panel.

2. A roofing panel of claim 1 wherein the panel means is a fiberboard panel.

3. A roofing panel of claim 1 wherein the membrane means is a bitumenized waterproof membrane.

4. A roofing panel of claim 1 further comprising a fire-retardant protective coating.

5. A roofing panel of claim 4 wherein the fire-retardant coating comprises a protective sheet applied to the panel.

6. A roofing panel of claim 1 wherein the blunt cut portion of a bevelled side edge is adjacent the top surface of the panel, and an edge of the membrane means is adhered to the top surface of the panel coincident with an edge of the blunt cut portion.

7. A roofing panel of claim 1 wherein the blunt cut portion of a bevelled side edge is adjacent the bottom surface of the panel, and the membrane means forms a lap extending outwardly from the top surface of said panel adjacent said bevelled portion of said bevelled side edge.

8. A roofing panel of claim 1 wherein the blunt cut portion of one bevelled side edge is adjacent the top surface of the panel, and an edge of the membrane means is adhered to the top surface of the panel coincident with an edge of the blunt cut portion, and a blunt cut portion of the opposite bevelled side edge is adjacent the bottom surface of the panel, and the membrane means forms a lap extending outwardly from the top surface of said panel adjacent said bevelled portion of said opposite bevelled side edge.

9. A roofing system comprising panels of claim 1, said system comprising a first row of panels placed end-to-end, the headlap of a first panel overlapping the end opposite the headlap of a second panel placed adjacent said first panel, a second row of panels similarly placed end-to-end, adjacent said first row of panels, having bevelled side edges interlocking with bevelled side edges of said first row of panels, sidelaps of said second row of panels overlapping said interlocked side edges of said first row of panels, headlaps of said second row of panels being staggered with respect to headlaps of said first row of panels.

10. A roofing system of claim 9 wherein a portion of each bevelled side edge is blunt cut adjacent a flat surface of the panel.

11. A roofing system of claim 10 wherein the blunt cut portion of one bevelled side edge is adjacent the top surface of the panel, and an edge of the membrane means is adhered to the top surface of the panel coincident with an edge of the blunt cut portion, and a blunt cut portion of the opposite bevelled side edge is adjacent the bottom surface of the panel, and the membrane means forms a lap extending outwardly from the top surface of said panel adjacent said bevelled portion of said opposite bevelled side edge.

12. A roofing system of claim 11 wherein channels are formed between the sidelap and adjoining bevelled side edge of one panel and the blunt cut portion of the side edge of the adjacent panel, whereby moisture and gases are channeled to the atmosphere through said channels.

13. A roofing system of claim 9 wherein the panels further comprise a fire-retardant protective coating.

14. A roofing system of claim 9 further comprising channel means beneath the sidelaps for conducting moisture and gases to the atmosphere.

15. A prefabricated roofing panel of claim 1 wherein the bevelled edge is cut at an angle of between about 30° to 60° to a top or bottom flat surface of the panel.

16. A prefabricated roofing panel of claim 1 wherein the panel means comprises a rectangular fiberboard panel and the waterproof membrane means comprises modified bitumen membrane.

17. A prefabricated roofing panel comprising:

fiberboard panel means for covering a roof, said panel means comprising top and bottom flat surface and two opposite parallel side edges bevelled at an angle to said top and bottom surfaces, and modified bitumen waterproof membrane means for covering said panel means, completely covering and adhered to the top surface of said panel means, said membrane means extending outwardly from said panel means at one end to form a headlap and at one side to form a sidelap, wherein the panel means is a rectangular panel, the longer pair of opposite side edges is bevelled at an angle of 30° to 60° to the top and bottom flat surfaces of the panel, the sidelap extends across one of said bevelled side edges, and a portion of each bevelled side edge is blunt cut adjacent one of the flat surfaces of the panel forming a bevelled portion adjacent one surface of the panel and a blunt cut portion adjacent the other surface of the panel.

* * * * *